US008256389B2

(12) United States Patent
Nomura et al.

(10) Patent No.: US 8,256,389 B2
(45) Date of Patent: Sep. 4, 2012

(54) CYLINDER BLOCK

(75) Inventors: Atsushi Nomura, Aichi-gun (JP); Seiji Omura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 472 days.

(21) Appl. No.: 12/449,864

(22) PCT Filed: Mar. 13, 2008

(86) PCT No.: PCT/JP2008/054632

§ 371 (c)(1),
(2), (4) Date: Sep. 1, 2009

(87) PCT Pub. No.: WO2008/114693

PCT Pub. Date: Sep. 25, 2008

(65) Prior Publication Data

US 2010/0095912 A1 Apr. 22, 2010

(30) Foreign Application Priority Data

Mar. 16, 2007 (JP) ..... 2007-068624

(51) Int. Cl.
*F02F 1/10* (2006.01)

(52) U.S. Cl. ..... 123/41.72; 123/41.74; 123/41.81

(58) Field of Classification Search ..... 123/41.72, 123/41.74, 41.81, 41.82 R, 41.01
See application file for complete search history.

(56) References Cited

U.S. PATENT DOCUMENTS

| | | | | |
|---|---|---|---|---|
| 4,280,453 | A * | 7/1981 | List et al. | 123/195 R |
| 5,755,028 | A * | 5/1998 | Takami et al. | 29/888.06 |
| 5,758,608 | A * | 6/1998 | Berger et al. | 123/41.33 |
| 5,957,103 | A * | 9/1999 | Takami et al. | 123/193.2 |
| 6,101,994 | A * | 8/2000 | Ichikawa | 123/195 R |
| 6,415,848 | B1 * | 7/2002 | Komazaki et al. | 164/340 |
| 7,077,079 | B2 * | 7/2006 | Matsuo | 123/41.74 |
| 2003/0172884 | A1 * | 9/2003 | Laufenberg et al. | 123/41.72 |

FOREIGN PATENT DOCUMENTS

| | | |
|---|---|---|
| JP | U-56-71936 | 6/1981 |
| JP | U-63-141862 | 9/1988 |
| JP | A-05-312037 | 11/1993 |
| JP | A-6-330808 | 11/1994 |
| JP | A-07-127519 | 5/1995 |
| JP | A-10-103055 | 4/1998 |
| JP | A-2005-337140 | 12/2005 |

OTHER PUBLICATIONS

Office Action issued in Chinese Application No. CN 200880008674.9 dated Jan. 18, 2011 (with translation).

Chinese Office Action issued in Chinese Application No. 200880008674.9 dated Aug. 31, 2011 (with translation).

* cited by examiner

*Primary Examiner* — Noah Kamen
*Assistant Examiner* — Long T Tran
(74) *Attorney, Agent, or Firm* — Oliff & Berridge, PLC

(57) ABSTRACT

An open deck type cylinder block (10) that is one embodiment of the present invention is configured as follows. A shallow portion (21) and a deep portion (22) are provided in a water jacket (20). The shallow portion (21) is provided in a portion that is comparatively far from a head bolt hole (17), while on the other hand the deep portion (22) is provided in a portion that is comparatively close to the head bolt hole (17). A hollow portion (18) in which a block outer wall is hollowed toward a cylinder center side is provided between a bottom wall portion of the shallow portion (21) and a skirt portion (14) used as a crank case.

10 Claims, 6 Drawing Sheets

CYLINDER BLOCK

TECHNICAL FIELD

The present invention relates to the structure of a cylinder block used in an internal combustion engine such as an automobile engine.

BACKGROUND ART

A cylinder block used in an automobile engine or the like is ordinarily manufactured by a casting process, but recently, in consideration of achieving high processing precision and shortening of the processing time, such cylinder blocks have also been often manufactured via die cast formation. In addition, in consideration of lightening the weight of the cylinder block, and so forth, cylinder blocks made of an aluminum alloy have also become widespread.

With respect to the shape of the cylinder block, there is an open deck type in which a water jacket serving as a coolant water path formed within the cylinder block is open at a block top face (face combined with the cylinder head: a deck face), and a closed deck type in which the water jacket is not open at the block top face. Of these types, the open deck type does not require a core in the casting process, and therefore is particularly suitable for a die cast cylinder block as described above.

As a conventional example of a die cast open deck type cylinder block, for example, technology as disclosed in PTL 1 has been proposed. In this technology, a water jacket in the vicinity of a head bolt hole where a head bolt for attaching the cylinder head is fastened has a shallowed structure. By adopting such a shallowed structure to reduce the width of the water jacket, so as to bring a cylinder bore and the head bolt hole closer together, the fastening force of the head bolt is easily transmitted around a cylinder bore, so sealing around the cylinder bore is improved, and rigidity of the outer wall and the inner wall (cylinder) of the water jacket is improved.

CITATION LIST

Patent Literature

[PTL 1]
JPS63-141862U

SUMMARY OF INVENTION

Technical Problem

Incidentally, recently, there have been demands to increase the cylinder internal pressure during an expansion stroke in order to achieve increased engine output. In particular, because the cylinder internal pressure is higher in a diesel engine than in a gasoline engine (at present, ordinarily about 16 MPa), greater strength becomes necessary in the cylinder block when attempting to achieve increased output by further increasing the cylinder internal pressure.

There are demands for the cylinder block to be strong enough to withstand the cylinder internal pressure during the expansion stroke of the engine. More specifically, because a particularly high stress acts on a portion where the cylinder internal pressure (combustion pressure) acts at the beginning of the expansion stroke (for example, the point in time when the crank rotation angle has advanced about several tens of degrees in terms of crank angle from the piston top dead center position), at which time the cylinder internal pressure is greatest, i.e., acts on a portion on the cylinder head side in the cylinder block (a portion on the upper side in an engine in which the cylinder axis extends in the vertical direction), high strength is required for this portion.

In particular, in an open deck type cylinder block as described above, the aforementioned stress acts greatly on a portion of the cylinder (cylinder bore outer wall portion) provided inside of the water jacket, so it is necessary to insure adequate strength in order to suppress deformation in this portion on the cylinder head side of the cylinder. However, on the other hand, it is also necessary to insure adequate cooling of the cylinder. In the cylinder, greater cooling is required for the portion on the cylinder head side of the cylinder than the portion on the crank case side (the portion on the lower side in an engine in which the cylinder axis extends in the vertical direction), which is on the opposite side as the cylinder head side.

Although above PTL 1 mentions adopting a shallowed structure for a water jacket in the vicinity of a head bolt hole, thus improving sealing around the cylinder bore, and rigidity of the outer wall and the inner wall (cylinder) of the water jacket, no measure is implemented with respect to cylinder cooling.

The present invention was made in consideration of such problems, and it is an object thereof to provide an open deck type cylinder block in which it is possible to suppress deformation at a cylinder head side portion of a cylinder (cylinder bore outer wall portion) provided inside of a water jacket, and furthermore, in which it is possible to insure adequate cooling of that cylinder.

Solution to Problem

In the present invention, a means for addressing the above problems is configured as follows. That is, in the present invention, in an open deck type cylinder block in which a water jacket is formed around a cylinder and this water jacket is open at a deck face: a shallow portion and a deep portion are provided in the water jacket; the shallow portion is provided in a portion that is comparatively far from a head bolt hole where a head bolt for attaching a cylinder head is fastened, while on the other hand the deep portion is provided in a portion that is comparatively close to the head bolt hole; and a hollow portion in which a block outer wall is hollowed toward a cylinder center side is provided between a bottom wall portion of the shallow portion and a crank case.

According to the above configuration, in the shallow portion of the water jacket, the distance from a top face (open face) to a bottom face is shorter than in a water jacket in which a shallowed structure is not adopted, thus shortening the length in a cylinder axis direction in which cylinder deformation is possible, so cylinder rigidity increases. As a result, it is possible to suppress deformation in a cylinder head side portion of the cylinder due to cylinder internal pressure.

Also, in the shallow portion of the water jacket, the cross sectional area of the flow path of the coolant water is reduced, so the flow rate of the coolant water is increased, and therefore it is possible to improve cooling in a cylinder head side portion of the cylinder. As a result, it is possible to insure adequate cooling in the cylinder head side portion of the cylinder. Also, at the start of an expansion stroke, at which time the cylinder internal pressure is greatest, it is possible to suppress an increase in the temperature of the cylinder head side portion of the cylinder, and along with this suppression of a temperature increase, it is possible to reduce a temperature difference between the cylinder head side portion and a crank case side portion of the cylinder. I.e., it is possible to suppress a temperature difference in the cylinder in the direction of the cylinder axis, and as a result it is possible to contribute to improved fuel consumption, for example.

Also, the portion on the crank case side of the cylinder is cooled by the release of heat from the hollow portion in the portion where the hollow portion is provided and that is comparatively far from a head bolt hole. On the other hand, in the portion that is comparatively close to the head bolt hole, the crank case side portion of the cylinder is cooled by the coolant water that flows through the lower portion of the deep portion of the water jacket. Thus, it is possible to insure cooling in the crank case side portion of the cylinder. In this case, in a portion that is comparatively far from a head bolt hole, it is possible to increase the width in the cylinder axis direction of the hollow portion by adopting the above sort of shallowed structure, so it is possible to improve cooling in the crank case side portion of the cylinder.

Here, in a portion that is comparatively far from a head bolt hole, when merely a shallowed structure is adopted and a hollow portion is not provided, the crank case side portion of the cylinder becomes thicker and so the heat capacity of that crank case side portion increases. As a result, cooling of the crank case side portion of the cylinder is impaired. Therefore, in a portion that is comparatively far from a head bolt hole, it is not the case that merely a shallowed structure is adopted, rather, a hollow portion is also provided in a portion corresponding to a shallow portion, thus insuring cooling in the crank case side portion of the cylinder. Moreover, by providing a hollow portion, it is possible to contribute to weight reduction of the cylinder block.

On the other hand, in a portion that is comparatively close to a head bolt hole, it is necessary to insure some amount of thickness for a boss portion of a head bolt hole, in order to suppress deformation of a cylinder bore when attaching a component while insuring fastening force of the head bolt. As a result, it is difficult to provide a portion such as a hollow portion in a portion that is comparatively close to a head bolt hole. Therefore, cooling of the crank case side portion of the cylinder is impaired by adopting a shallowed structure in the water jacket in this portion as well. Accordingly, in a portion that is comparatively close to a head bolt hole, a shallowed structure is not adopted, and cooling of the crank case side portion of the cylinder is insured by the deep portion of the water jacket.

Above, a configuration is adopted in which a hollow portion is provided between the shallow portion of the shallow portion of the water jacket and the crank case, but a configuration may also be adopted in which instead of such a hollow portion, a coolant water path is provided. Also, a configuration may be adopted in which both such a hollow portion and a coolant water path are provided. Here, for example, the coolant water path can be formed by a drilling process.

Also, it is preferable that an inclined portion having an inclined bottom face is provided between the shallow portion and the deep portion of the water jacket.

By providing an inclined portion between the shallow portion and the deep portion in this way, the coolant water flows more smoothly than in a case where such an inclined portion is not provided, so cylinder cooling can be further improved. Also, by providing an inclined portion, processing of the coolant water path is more easily performed. For example, when the coolant water path is formed by a drilling process, the bottom face of the inclined portion can be used as the processing face of the drilling process.

Advantageous Effects of Invention

According to the present invention, in an open deck type cylinder block, it is possible to suppress deformation at a cylinder head side portion of a cylinder (cylinder bore outer wall portion) provided inside of a water jacket, and furthermore, it is possible to insure adequate cooling of that cylinder.

REFERENCE SIGNS LIST

Figure 1:
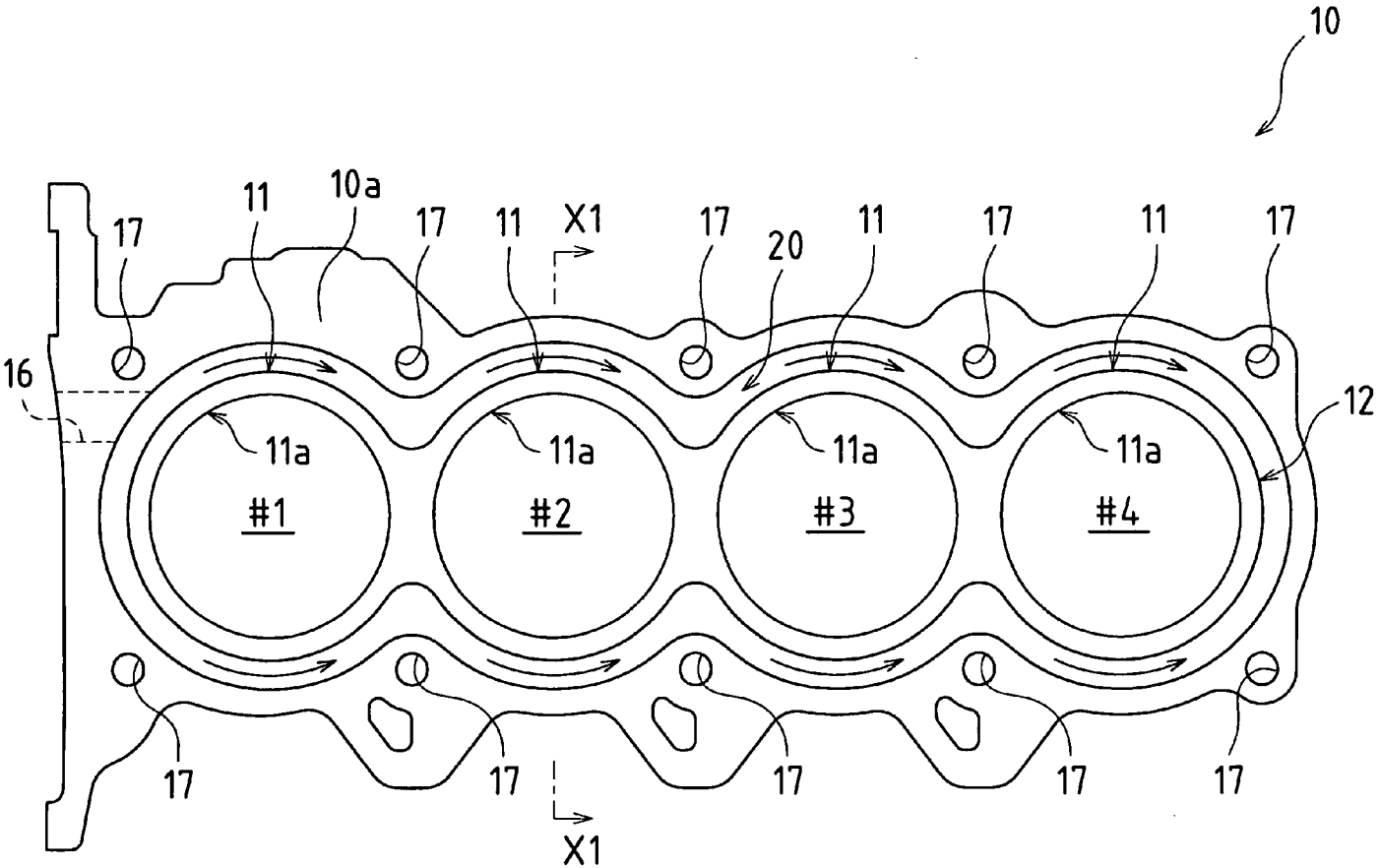
FIG. 1 is a plan view that shows a cylinder block according to a first embodiment of the present invention.

10 Cylinder block
10*a* Deck face
11 Cylinder liner
11*a* Cylinder bore
12 Cylinder liner portion
13 Block outer wall portion
13*a* Bottom wall portion
17 Head bolt hole
18 Hollow portion
20 Water jacket
21 Shallow portion
21*a* Bottom face
22 Deep portion
22*a* Bottom face
23 Inclined portion
23*a* Bottom face

DESCRIPTION OF EMBODIMENTS

Following is a description of embodiments of the invention based on the drawings.

Following is a description of first and second embodiments in which the present invention is applied to a die cast cylinder block having a siamese structure used in an in-line four-cylinder diesel engine for use in an automobile.

First Embodiment (General Configuration of Cylinder Block)

Figure 2:
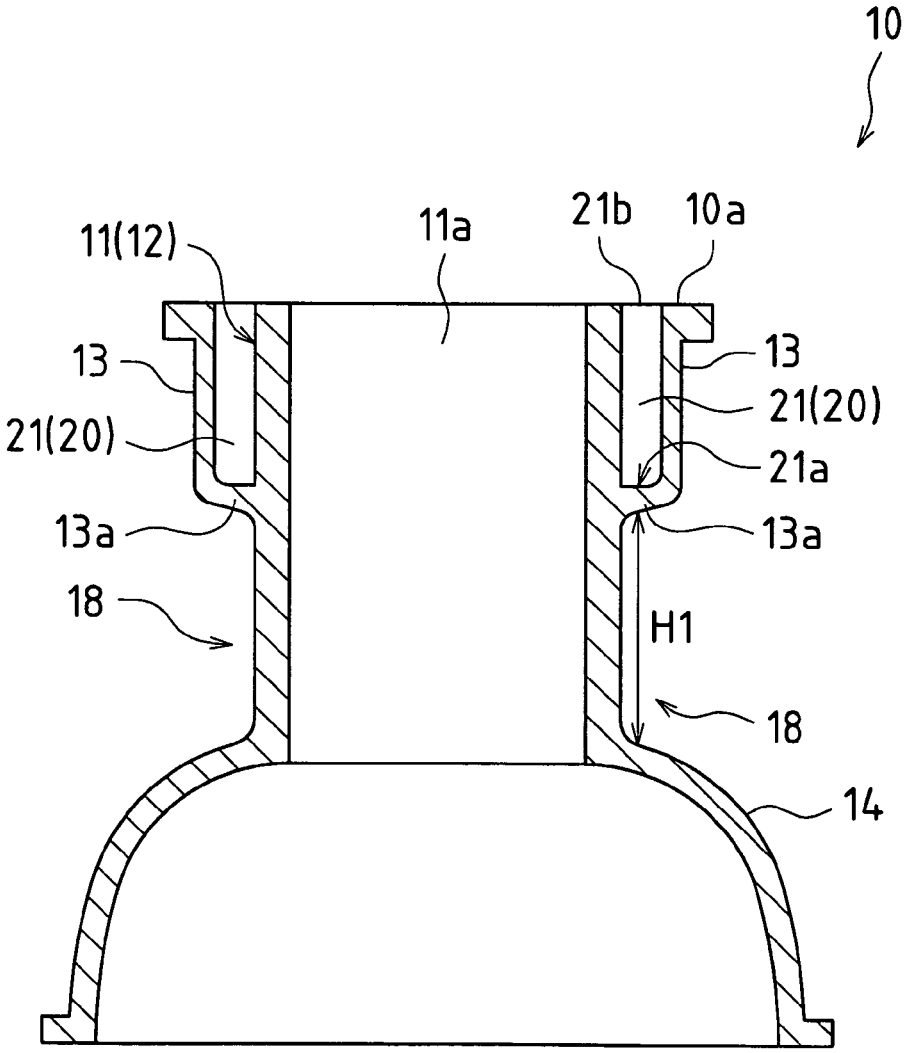
FIG. 2 is a cross-sectional view along line X1-X1 in FIG. 1.

First is a description of the general configuration of the cylinder block according to the first embodiment of the present invention, with reference to FIGS. 1 and 2.

FIG. 1 is a plan view of a cylinder block 10 (end face view of the upper portion of the cylinder block 10) that shows cylinder bores 11*a*, and the vicinity thereof, of the in-line four-cylinder diesel engine according to the first embodiment. FIG. 1 shows the arrangement state of a deck face 10*a* (cylinder block top face) that is a combined face with a cylinder head, a line of cylinders, and a water jacket (coolant water path) 20. FIG. 2 is a cross-sectional view along line X1-X1 in FIG. 1, and shows shallow portions 21 of the water jacket 20, and hollow portions 18 that are positioned below the shallow portions 21.

In this description, it is assumed that the cylinder axis extends in the vertical direction, the deck face 10*a* side of the cylinder block 10 is upward, and a skirt portion 14 side is downward. Also, in this description, in FIG. 1, the cylinder positioned at the left end is referred to as a first cylinder #1, the cylinder on the right side of the first cylinder #1 is referred to as a second cylinder #2, the cylinder on the right side of the second cylinder #2 is referred to as a third cylinder #3, and the cylinder on the right side of the third cylinder #3 is referred to as a fourth cylinder #4. Further, in this description, in FIG. 1, the upper side is referred to as an intake side and the lower side is referred to as an exhaust side. However, the cylinder axis direction, cylinder numbers, and form of the intake/exhaust system are examples, and are not limited to these examples.

The cylinder block 10 according to this embodiment is made of an aluminum alloy, and is manufactured via die case molding. The cylinder block 10 is provided with a cylinder portion 12 in which four cylinders 11 are disposed in a straight line, block outer wall portions 13 disposed on the outer circumferential side of the cylinder portion 12, and the skirt portion 14 used as a crank case disposed on the lower side of the cylinder portion 12 and the block outer wall portions 13.

The cylinder portion 12 is formed in a shape in which the four cylinder bodies serving as the cylinders 11 are successively connected in a straight line. In this way, the cylinder block 10 exhibits a so-called siamese structure in order to achieve less size and weight of the cylinder block 10, and shortening of the length in the direction of the line of cylinders. Each cylinder 11 serves as an outer wall portion of a cylinder bore 11*a* where a piston slides. That is, each cylinder 11 constitutes the inner face of a cylinder bore 11*a*.

The block outer wall portions 13 are formed facing the cylinder portion 12 with a predetermined gap between the block outer wall portions 13 and the cylinder portion 12. The water jacket 20 is formed by the outer wall face of the cylinder portion 12 and the inner wall face of the block outer wall portions 13. The water jacket 20 is provided so as to surround approximately the entire circumference of the four cylinders 11, and is extended along the cylindrical face shape that serves as the outer wall face of the cylinders 11. Also, the water jacket 20 is open at the deck face 10*a*, which is the installation face (head mounting face) of the cylinder head. That is, the cylinder block 10 is configured as an open deck type cylinder block.

In the block outer wall portions 13, a coolant water entrance path 16 for introducing coolant water (coolant fluid) from a water pump (not shown) to the water jacket 20 is formed at one end side (the left end side in FIG. 1) in the cylinder line direction, i.e., is formed in the vicinity of the first cylinder #1. As for the main flow of coolant water in the water jacket 20, coolant water that has been introduced from the coolant water entrance path 16 flows in approximately the horizontal direction along the cylinder line direction, and thus the cylinder block 10 is cooled. Specifically, the flow of coolant water introduced from the coolant water entrance path 16 is divided to one side (the intake side on the upper side in FIG. 1) and the other side (the exhaust side on the lower side in FIG. 1) of the cylinder portion 12, and the flow on each side flows in approximately the horizontal direction from the first cylinder #1 to the fourth cylinder #4 (see arrows in FIG. 1), thus cooling the cylinder block 10. The coolant water that has cooled the cylinder block 10 afterward flows into a water jacket of the cylinder head, thus cooling the cylinder head. Note that the position of the coolant water entrance path 16 in the cylinder block 10 and the circulation path of coolant water in the water jacket 20 are examples, and are not limited to these examples. For example, a configuration may be adopted in which the coolant water entrance path is provided in a portion of the exhaust side of the block outer wall portions 13, between the second cylinder #2 and the third cylinder #3.

Also, head bolt holes 17 where head bolts for attaching a cylinder head gasket and a cylinder head as a single body are fastened are formed at a plurality of locations of the block outer wall portions 13. In this embodiment, four of the head bolt holes 17 are provided for each cylinder 11 (cylinder bore 11*a*). Specifically, four of the head bolt holes 17 are provided at approximately equal intervals around each cylinder bore 11*a*, in other words, at 90 degree intervals viewed from the center (cylinder center) of the cylinder bore 11*a*. Intake side and exhaust side head bolt holes 17 provided between an adjacent pair of cylinder bores 11*a* are shared by that pair of cylinder bores 11*a*. A total of 10 head bolt holes 17 are provided for the four cylinder bores 11*a*. That is, a total of six head bolt holes 17 provided between adjacent cylinder bores 11*a* (for example, head bolt hole 17A in FIG. 3), and a total of four head bolt holes 17 provided at the left and right ends (for example, head bolt hole 17B in FIG. 3), are provided.

Distinguishing Portions of First Embodiment

Figure 3:
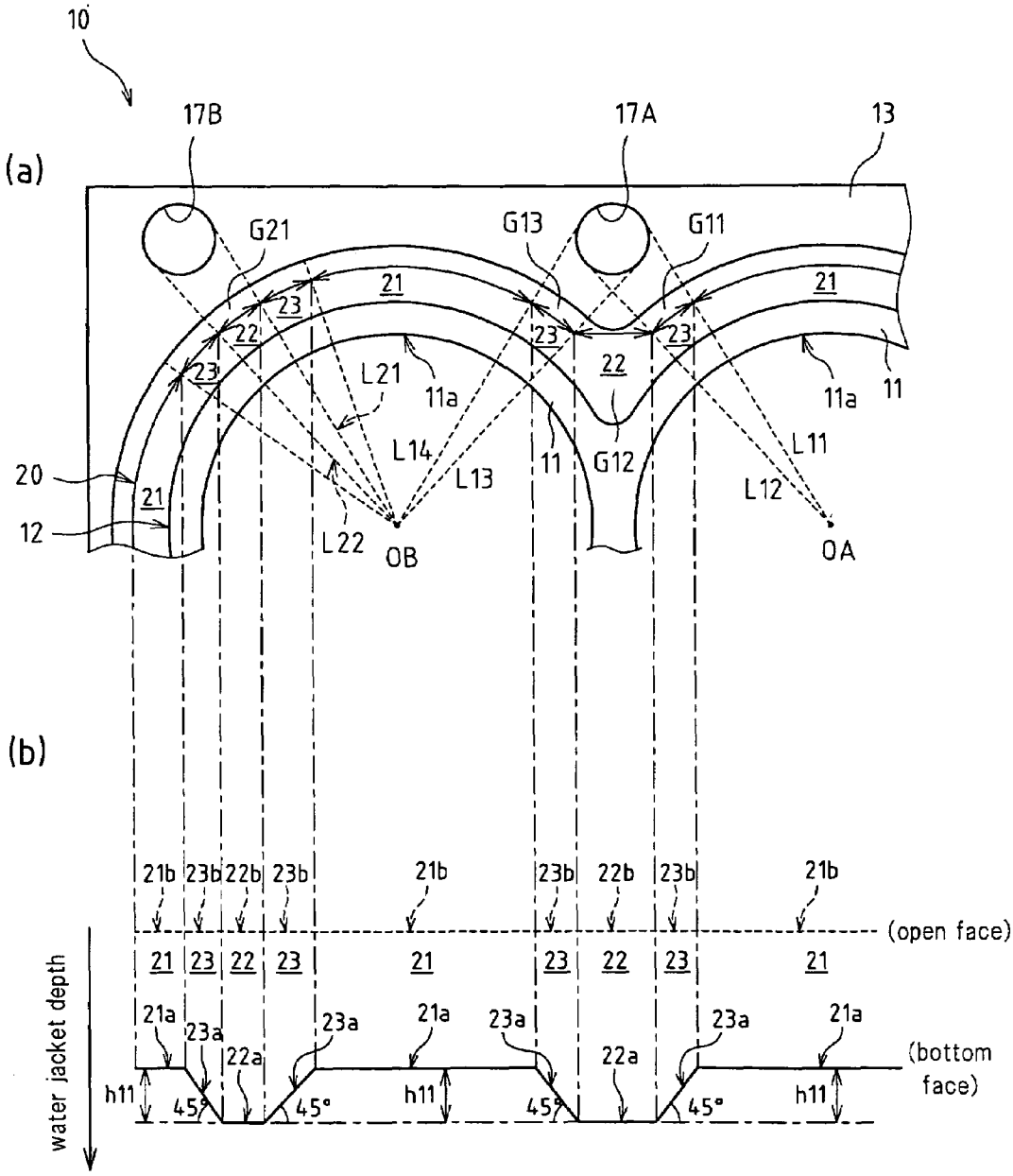
FIGS. 3(*a*) and 3(*b*) show a shallow portion and a deep portion provided in a water jacket of a cylinder head in FIG. 1.

Next is a description of distinguishing portions of the cylinder block 10 of this embodiment, with reference to FIGS. 1 to 3.

FIG. 3 shows shallow portions, deep portions, and inclined portions provided in the water jacket. FIG. 3(*a*) is a plan view that shows part of those portions, and FIG. 3(*b*) shows changes in the depth of the water jacket in that part of those portions.

In this embodiment, the depth of the water jacket 20 of the cylinder block 10, i.e., the distance from a top face (open face) to a bottom face, is not fixed, but rather differs by location, and a shallowed structure is adopted in part of the water jacket 20. Specifically, as shown in FIGS. 3(*a*) and 3(*b*), shallow portions 21 and deep portions 22 are provided in the water jacket 20. Also, the portions between the shallow portions 21 and the deep portions 22 are inclined portions 23. The shallow portions 21, deep portions 22, and inclined portions 23 are not shown in FIG. 1.

The shallow portions 21 are portions where the depth of the water jacket 20 is shallow, i.e., portions where the distance from an open face 21*b* to a bottom face 21*a* is small. The bottom faces 21*a* of the shallow portions 21 are flat faces parallel to the open faces 21*b*. A plurality of the shallow portions 21 are provided in the water jacket 20, and the depth of these shallow portions 21 is the same.

The deep portions 22 are portions where the depth of the water jacket 20 is deep, i.e., portions where the distance from an open face 22*b* to a bottom face 22*a* is large. The bottom faces 22*a* of the deep portions 22 are flat faces parallel to the open faces 22*b*. A plurality of the deep portions 22 are provided in the water jacket 20, and the depth of these deep portions 22 is the same.

The inclined portions 23 are portions provided between the shallow portions 21 and the deep portions 22. Bottom faces 23*a* of the inclined portions 23 are flat faces inclined at a predetermined angle relative to the open faces 23*b* of the flat faces 23*a* of the inclined portions 23. A plurality of the inclined portions 23 are provided in the water jacket 20.

The shallow portions 21, the deep portions 22, and the inclined portions 23 are disposed symmetrically between the intake side and the exhaust side in the cylinder block 10, and symmetrically between the first cylinder #1 and the fourth cylinder #4, and symmetrically between the second cylinder #2 and the third cylinder #3, and symmetrical relative to line X1-X1 that passes through the cylinder center in the second cylinder #2. Furthermore, in the third cylinder #3, the shallow portions 21, the deep portions 22, and the inclined portions 23 are disposed symmetrical relative to a line that passes through the cylinder center and is parallel to the aforementioned line X1-X1.

The locations where the shallow portions 21 and the deep portions 22 of the water jacket 20 are provided are set according to the positional relationship with the head bolt holes 17. Specifically, the deep portions 22 are provided in portions that are comparatively close to the head bolt holes 17 (portions in the vicinity of the head bolt holes 17), and the shallow portions 21 are provided in portions that are comparatively far from the head bolt holes 17 (portions other than in the vicinity of the head bolt holes 17). Below, the vicinity of head bolt holes 17 provided between adjacent cylinder bores 11*a* (for example, the head bolt hole 17A in FIG. 3) and the vicinity of head bolt holes 17 provided on the left and right ends (for example, the head bolt hole 17B in FIG. 3) are described separately.

First is a description of the water jacket 20 in the vicinity of the six head bolt holes 17 provided between adjacent cylinder bores 11*a* of the cylinder block 10. Here, the vicinity of the head bolt hole 17A shown in FIG. 3) is described as a representative example.

In this case, a deep portion 22 and a pair of inclined portions 23 are provided in the portion closest to the head bolt hole 17A. Specifically, in a plan view, the deep portion 22 is provided in a portion where the head bolt hole 17A and a siamese portion (connecting portion) between the cylinder bores 11*a* face each other, and the inclined portions 23 are provided on both sides of that facing portion.

More specifically, in a plan view, one of the inclined portions 23 is provided in a range G11 sandwiched by two tangent lines L11 and L12 to the head bolt hole 17A that extend from a center OA of one of the cylinder bores 11*a*. In a plan view, the other inclined portion 23 is provided in a range G13 sandwiched by two tangent lines L13 and L14 to the head bolt hole 17A that extend from a center OB of the other cylinder bore 11*a*. The deep portion 22 is provided between this pair of inclined portions 23. That is, in a plan view, the deep portion 22 is provided in a range G12 sandwiched by the two tangent lines L12 and L13.

Also, shallow portions 21 are respectively provided outside of the tangent lines L11 (the right side in FIG. 3(*a*)) and L14 (the left side in FIG. 3(*a*)), i.e., outside of the ranges G11, G12, and G13 sandwiched by the two tangent lines L11 and L14. The shallow portions 21 are respectively provided up to the border with the inclined portions 23 provided in the vicinity of other head bolt holes 17.

Bottom faces 23*a* of the inclined portions 23 are inclined at a predetermined angle (in this case, 45 degrees). That is, an angle formed by the bottom face 22*a* of a deep portion 22 and the bottom face 23*a* of an inclined portion 23 is 135 degrees. Also, an angle formed by the bottom face 21*a* of a shallow portion 21 and the bottom face 23*a* of an inclined portion 23 is 225 degrees (135 degrees). In this case, the range of the inclined portions 23 is set to the above ranges G11 and G13, so a height difference h11 between the bottom face 21*a* of a shallow portion 21 and the bottom face 22*a* of a deep portion 22 can be set such that the inclination angle of the bottom face 23*a* of each inclined portion 23 is 45 degrees.

In this way, in the vicinity of the head bolt hole 17A, the deep portion 22 and the pair of inclined portions 23 are provided in a portion that is comparatively close to the head bolt hole 17A, and on the other hand, the shallow portions 21 are provided in a portion that is comparatively far from the head bolt hole 17A.

Next is a description of the water jacket 20 in the vicinity of the four head bolt holes 17 provided at the left and right ends of the cylinder block 10. Here, the vicinity of the head bolt hole 17B shown in FIG. 3 is described as a representative example.

In this case, a deep portion 22 is provided in a portion closest to the head bolt hole 17. Specifically, in a plan view, the deep portion 22 is provided in a portion facing the head bolt hole 17B in the direction in which the head bolt hole 17B and the center OB of the cylinder bore 11*a* face each other.

More specifically, in a plan view, the deep portion 22 is provided in a range G21 sandwiched by two tangent lines L21 and L22 to the head bolt hole 17B that extend from the center OB of the cylinder bore 11*a*. An inclined portion 23 is provided on both sides of the deep portion 22, and a shallow portion 21 is provided on both sides of the pair of inclined portions 23. Each of the shallow portions 21 is provided up to the border with the inclined portions 23 that are provided in the vicinity of other head bolt holes 17.

The bottom faces 23*a* of the inclined portions 23 are inclined at a predetermined angle (in this case, 45 degrees). That is, an angle formed by the bottom face 22*a* of a deep portion 22 and the bottom face 23*a* of an inclined portion 23 is 135 degrees. Also, an angle formed by the bottom face 21*a* of a shallow portion 21 and the bottom face 23*a* of an inclined portion 23 is 225 degrees (135 degrees). In this case, as described above, the height difference between the bottom face 21*a* of a shallow portion 21 and the bottom face 22*a* of a deep portion 22 is set to h11, so the range of the inclined portions 23 can be set such that the inclination angle of the bottom face 23*a* of each inclined portion 23 is 45 degrees.

In this way, in the vicinity of the head bolt hole 17B, a deep portion 22 and a pair of inclined portions 23 are provided in a portion that is comparatively close to the head bolt hole 17B, while on the other hand, shallow portions 21 are provided in a portion that is comparatively far from the head bolt hole 17B.

Also, in this embodiment, as shown in FIG. 2, hollow portions (cast portions) 18 in which a block outer wall extends towards the inside (the side of the cylinder center) are provided below the shallow portions 21 of the water jacket 20. This is described in detail below.

The hollow portions 18 are portions between bottom wall portions 13*a* that form a bottom wall of the water jacket 20 in the block outer wall portions 13 and a skirt portion 14, and the hollow portions 18 are formed so as to be hollowed towards the inside. A concave hollowed space is formed on the outside of the lower portion of the cylinder 11 where the hollow portions 18 are provided. The hollowed space is a concave space where a portion between the bottom wall portions 13*a* of the block outer wall portions 13 and the skirt portion 14 is formed so as to be hollowed towards the inside.

The hollow portions 18 are provided in a portion that is comparatively far from a head bolt hole 17 of the cylinder block 10. As described above, the shallow portions 21 of the water jacket 20 are provided in a portion that is comparatively far from a head bolt hole 17. Therefore, shallow portions 21 and hollow portions 18 are both provided in a portion that is comparatively far from a head bolt hole 17.

Note that a configuration may be adopted in which the hollow portions 18 are provided only in the area below the shallow portions 21, but a configuration may also be adopted in which the hollow portions 18 are provided expanded to the area below the inclined portions 23 on both sides of the shallow portions 21, and not only in the area below the shallow portions 21. However, for reasons described below, it is difficult to provide the hollow portions 18 in the area below the deep portions 22.

In this way, in the cylinder block 10, the hollow portions 18 are provided corresponding to the shallow portions 21 of the water jacket 20. Accordingly, the hollow portions 18 are disposed symmetrically between the intake side and the exhaust side in the cylinder block 10, and symmetrically between the first cylinder #1 and the fourth cylinder #4, and symmetrically between the second cylinder #2 and the third cylinder #3, and symmetrical relative to line X1-X1 (see FIG. 2) that passes through the cylinder center in the second cylinder #2. Furthermore, in the third cylinder #3, the hollow portions 18 are disposed symmetrical relative to a line that passes through the cylinder center and is parallel to the aforementioned line X1-X1.

Working Effects of First Embodiment

According to the cylinder block 10 of the first embodiment as described above, the following working effects are obtained.

In the shallow portions 21 of the water jacket 20 of the cylinder block 10, the distance from the open faces 21*b* to the bottom faces 21*a* is shorter than in a water jacket in which a shallowed structure is not adopted, thus shortening the length in a cylinder axis direction in which deformation of the cylinders 11 is possible, so rigidity of the cylinders 11 increases. As a result, it is possible to suppress deformation in a cylinder head side portion (in this case, an upper portion of the cylinders 11) of the cylinders 11 due to cylinder internal pressure.

Also, in the shallow portions 21 of the water jacket 20, the cross sectional area of the flow path of the coolant water is reduced, so the flow rate of the coolant water is increased, and therefore it is possible to improve cooling in the upper portion of the cylinders 11. As a result, it is possible to insure adequate cooling in the upper portion of the cylinders 11. Also, at the start of an expansion stroke, at which time the cylinder internal pressure is greatest, it is possible to suppress an increase in the temperature of the upper portion of the cylinders 11, and along with this suppression of a temperature increase, it is possible to reduce a temperature difference between the upper portion and the lower portion of the cylinders 11. I.e., it is possible to suppress a temperature difference in the cylinders 11 in the direction of the cylinder axis, and as a result it is possible to contribute to improved fuel consumption, for example.

Also, the portion on the crank case side of the cylinders 11 (in this case, the lower portion of the cylinders 11) is cooled by the release of heat from the hollow portions 18 to the hollowed space in the portions where the hollow portions 18 are provided and that are comparatively far from a head bolt hole 17. On the other hand, in the portions where the hollow portions 18 are not provided and that are comparatively close to a head bolt hole 17, the lower portion of the cylinders 11 is cooled by the coolant water that flows through the lower portion of the deep portions 22 of the water jacket 20. Thus, it is possible to insure cooling in the lower portion of the cylinders 11.

Here, in a portion that is comparatively far from a head bolt hole 17, when merely a shallowed structure is adopted and the hollow portions 18 are not provided, the lower portion of the cylinders 11 becomes thicker and so the heat capacity of that lower portion increases. As a result, cooling of the lower portion of the cylinders 11 is impaired. Therefore, in this embodiment, in a portion that is comparatively far from a head bolt hole 17, in addition to adopting a shallowed structure, hollow portions 18 are also provided in portions corresponding to the shallow portions 21, thus insuring cooling in the lower portion of the cylinders 11. Moreover, by providing the hollow portions 18, it is possible to contribute to weight reduction of the cylinder block 10.

In this case, in a portion that is comparatively far from a head bolt hole 17, by adopting a shallowed structure, it is possible to make a width (height) H1 in the cylinder axis direction of the hollowed portions 18 greater than in a case of not adopting a shallowed structure. More specifically, if the thickness of the bottom wall portions 13*a* of the block outer wall portions 13 are made the same as in a case of not adopting a shallowed structure, the bottom wall portions 13*a* that correspond to the shallow portions 21 are provided higher (for example, higher by the height difference h11 between the bottom face 21*a* of a shallow portion 21 and the bottom face 22*a* of a deep portion 22) than in a case of not adopting a shallowed structure. Accordingly, to that extent, the height H1 of the hollowed portions 18 increases. Therefore, it is possible to improve cooling of the lower portion of the cylinders 11.

On the other hand, in a portion that is comparatively close to a head bolt hole 17, it is necessary to insure some amount of thickness for a boss portion of a head bolt hole 17 in the block outer wall portions 13, in order to suppress deformation of the cylinder bore 11*a* when attaching a component while insuring fastening force of the head bolt. As a result, it is difficult to provide a portion such as the hollow portions 18 in a portion that is comparatively close to a head bolt hole 17. Therefore, cooling of the lower portion of the cylinders 11 is impaired by adopting a shallowed structure in the water jacket in this portion as well. Accordingly, in a portion that is comparatively close to a head bolt hole 17, a shallowed structure is not adopted, and cooling of the lower portion of the cylinders 11 is insured by the deep portions 22 of the water jacket 20.

Also, by providing an inclined portion 23 between a shallow portion 21 and a deep portion 22, the coolant water flows more smoothly than in a case where such an inclined portion 23 is not provided, so cooling of the cylinders 11 can be further improved.

Second Embodiment

Next is a description of a second embodiment of the present invention. This embodiment differs from the above first embodiment in that a separate coolant water path is provided below the shallow portions of the water jacket. On the other hand, this embodiment is the same as the first embodiment with respect to the general configuration of the cylinder block, and shallow portions, deep portions, and inclined portions being provided in the water jacket. That is, in this embodiment as well, a shallowed structure is adopted in part of the water jacket. Below, mainly the points that differ from the first embodiment will be described.

Figure 4:
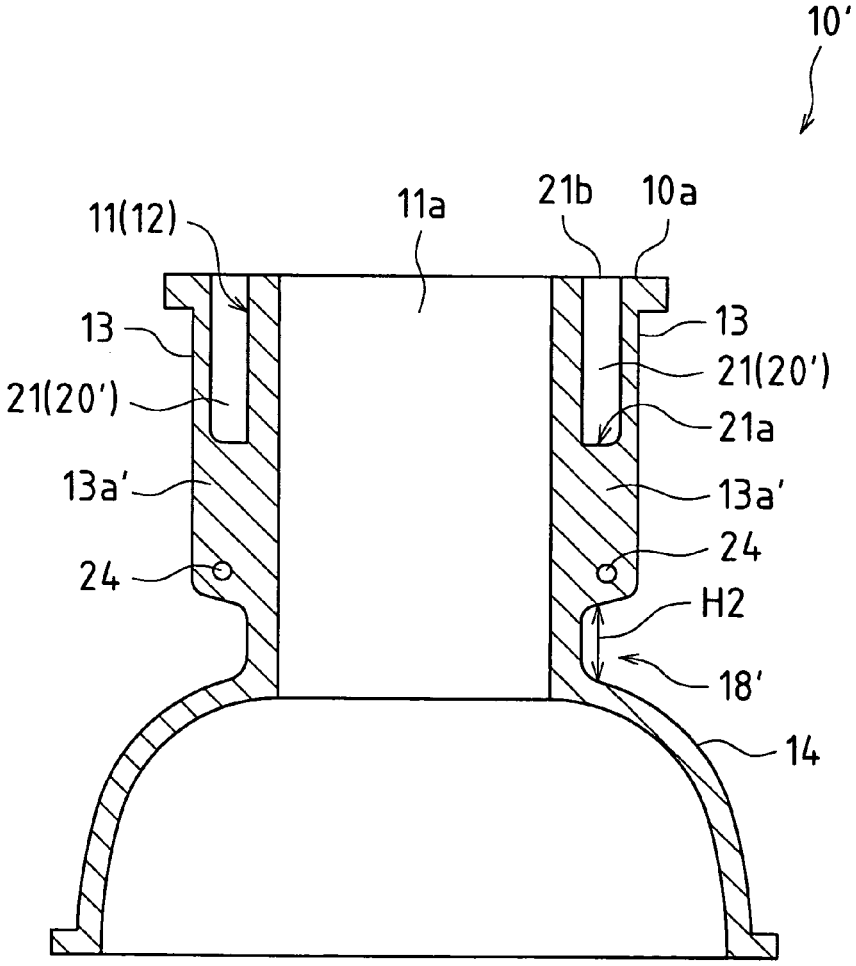
FIG. 4 shows a cylinder block according to a second embodiment of the present invention, and corresponds to FIG. 2.
Figure 5:
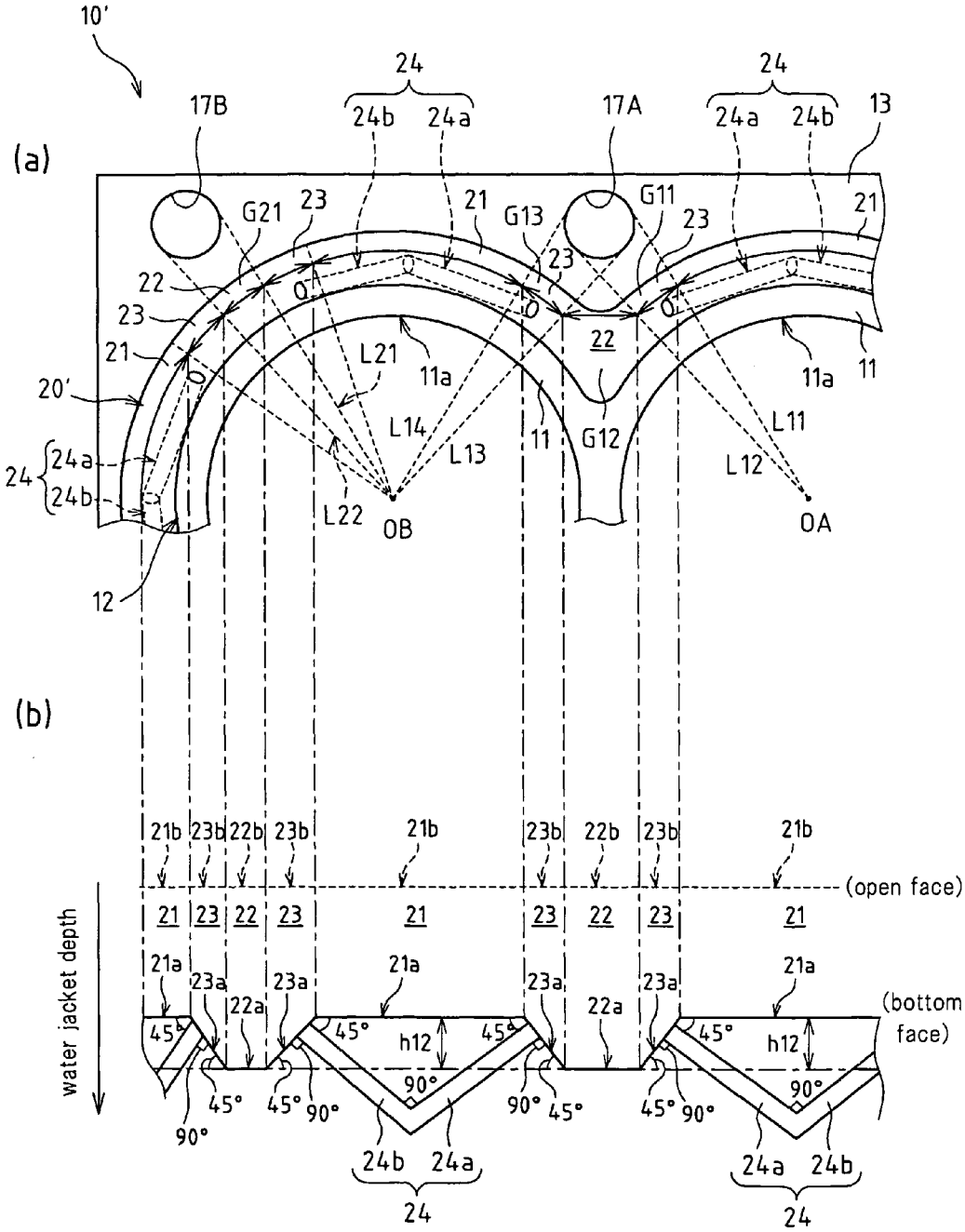
FIGS. 5(*a*) and 5(*b*) show shallow portions, deep portions, and coolant water paths that are provided in the water jacket of the cylinder head in FIG. 4, and correspond to FIGS. 3(*a*) and 3(*b*).

FIG. 4 shows a cylinder block 10' according to this second embodiment of the present invention, and corresponds to FIG. 2. FIG. 4 shows shallow portions 21 of a water jacket 20', coolant water paths 24 positioned below the shallow portions 21, and hollow portions 18' positioned below the coolant water paths 24. FIG. 5 shows the shallow portions 21, the deep portions 22, the inclined portions 23, and the coolant water paths 24 that are provided in the water jacket 20'. FIG. 5(*a*) is a plan view that shows an extracted part of the cylinder block 10', and FIG. 5(*b*) shows changes in the depth (the distance from an open face to a bottom face) of the water jacket 20' in that extracted part.

In this embodiment, as shown in FIG. 4 and FIG. 5, separate coolant water paths 24 are provided below the shallow portions 21 of the water jacket 20' of the cylinder block 10'. In the cylinder block 10', a plurality of coolant water paths 24 are provided around the four cylinders 11 (cylinder portions 12). The coolant water paths 24 are holes having a circular cross-sectional shape formed in bottom wall portions 13*a*' that form the bottom wall of the water jacket 20' in the block outer wall portions 13 of the cylinder block 10', and are formed with a smaller diameter than the width of the water jacket 20'.

Specifically, the coolant water paths 24 are configured using holes 24*a* and 24*b* that each extend in a straight line from the inclined portions 23 on both sides of the shallow portions 21 toward the shallow portions 21. The holes 24*a* and 24*b* are formed by hole processing using a drill or the like, for example.

Here, in a cross-sectional view, the holes 24*a* and 24*b* of the coolant water paths 24 extend in a predetermined direction, (in this case, an orthogonal direction) relative to the bottom faces 23*a* of the inclined portions 23. That is, the inclination angle of the holes 24*a* and 24*b* relative to the deck face 10*a* is 45 degrees. Also, the ends of the holes 24*a* and 24*b* are connected to each other below the shallow portions 21. That is, the holes 24*a* and 24*b* are connected to each other in a state in which the holes 24*a* and 24*b* are bent at a predetermined angle (in this case, 90 degrees).

Also, in a plan view, the holes 24*a* and 24*b* of the coolant water paths 24 are provided overlapping the area of the water jacket 20'. The holes 24*a* and 24*b* are provided in a portion near the cylinders 11, not in a portion near the block outer wall portions 13 of the water jacket 20'. Also, the holes 24*a* and 24*b* are connected to each other in a state in which the holes 24*a* and 24*b* are bent at a predetermined angle.

Also, in this embodiment, as shown in FIG. 4, hollow portions (cast portions) 18' in which a block outer wall extends towards the inside (the side of the cylinder center) are provided below the shallow portions 21 of the water jacket 20'. The hollow portions 18', having approximately the same configuration as the hollow portions 18 in the first embodiment above (see FIG. 2), are portions between bottom wall portions 13*a*' that form a bottom wall of the water jacket 20' in the block outer wall portions 13 and a skirt portion 14, and the hollow portions 18' are formed so as to be hollowed towards the inside. A concave hollowed space is formed on the outside of the lower portion of the cylinder 11 where the hollow portions 18' are provided. However, because the bottom wall portions 13*a*' of the block outer wall portions 13 are thick, by providing the coolant water paths 24 as described above, a width (height) H2 in the cylinder axis direction of the hollow portions 18' is less than the height H1 of the hollow portions 18 in the above first embodiment.

The coolant water paths 24 and the hollow portions 18' are provided in a portion that is comparatively far from a head bolt hole 17 of the cylinder block 10'. Shallow portions 21 of the water jacket 20' are provided in this portion that is comparatively far from a head bolt hole 17. Therefore, the shallow portions 21, and the coolant water paths 24 and the hollow portions 18', are provided in a portion that is comparatively far from a head bolt hole 17.

In this way, in the cylinder block 10', the coolant water paths 24 and the hollow portions 18' are provided corresponding to the shallow portions 21 of the water jacket 20'. Accordingly, the coolant water paths 24 and the hollow portions 18' are disposed symmetrically between the intake side and the exhaust side in the cylinder block 10', and symmetrically between the first cylinder #1 and the fourth cylinder #4, and symmetrically between the second cylinder #2 and the third cylinder #3, and symmetrical relative to line X1-X1 (see FIG. 2) that passes through the cylinder center in the second cylinder #2. Furthermore, in the third cylinder #3, the coolant water paths 24 and the hollow portions 18' are disposed symmetrical relative to a line that passes through the cylinder center and is parallel to the aforementioned line X1-X1.

According to the cylinder block 10' of the second embodiment as described above, approximately the same working effects are obtained as with the cylinder block 10 of the above first embodiment.

Specifically, in the shallow portions 21 of the water jacket 20' of the cylinder block 10', the distance from the open faces 21*b* to the bottom faces 21*a* is shorter than in a water jacket in which a shallowed structure is not adopted, thus shortening the length in a cylinder axis direction in which deformation of the cylinders 11 is possible, so rigidity of the cylinders 11 increases. As a result, it is possible to suppress deformation in a cylinder head side portion (in this case, an upper portion of the cylinders 11) of the cylinders 11 due to cylinder internal pressure.

Also, in the shallow portions 21 of the water jacket 20', the flow rate of the coolant water is increased, and therefore it is possible to improve cooling in the upper portion of the cylinders 11. As a result, it is possible to insure adequate cooling in the upper portion of the cylinders 11. Also, at the start of an expansion stroke, at which time the cylinder internal pressure is greatest, it is possible to suppress an increase in the temperature of the upper portion of the cylinders 11, and along with this suppression of a temperature increase, it is possible to reduce a temperature difference between the upper portion and the lower portion of the cylinders 11. I.e., it is possible to suppress a temperature difference in the cylinders 11 in the direction of the cylinder axis, and as a result it is possible to contribute to improved fuel consumption, for example.

Also, the portion on the crank case side of the cylinders 11 (in this case, the lower portion of the cylinders 11) is cooled by cooling by the coolant water that flows through the coolant water paths 24 and the release of heat from the hollow portions 18' to the hollowed space in the portions where the coolant water paths 24 and the hollow portions 18' are provided and that are comparatively far from a head bolt hole 17. On the other hand, in the portions where the coolant water paths 24 and the hollow portions 18' are not provided and that are comparatively close to a head bolt hole 17, the lower portion of the cylinders 11 is cooled by the coolant water that flows through the lower portion of the deep portions 22 of the water jacket 20'. Thus, it is possible to insure cooling in the lower portion of the cylinders 11.

Here, in a portion that is comparatively far from a head bolt hole 17, when merely a shallowed structure is adopted and the coolant water paths 24 and the hollow portions 18' are not provided, the lower portion of the cylinders 11 becomes thicker and so the heat capacity of that lower portion increases. As a result, cooling of the lower portion of the cylinders 11 is impaired. Therefore, in this embodiment, in a portion that is comparatively far from a head bolt hole 17, in addition to adopting a shallowed structure, coolant water paths 24 and hollow portions 18' are also provided in portions corresponding to the shallow portions 21, thus insuring cooling in the lower portion of the cylinders 11. Moreover, by providing the hollow portions 18', it is possible to contribute to weight reduction of the cylinder block 10. In this case, in a portion that is comparatively far from a head bolt hole 17, the release of heat to a hollowed space is less than in the above first embodiment, to the extent that the height H2 of the hollow portions 18' is less than the height H1 of the hollow portions 18 in the above first embodiment. Consequently, by proactively cooling the lower portion of the cylinders 11 by separately providing the coolant water paths 24, cooling of the lower portion of the cylinders 11 is improved.

On the other hand, in a portion that is comparatively close to a head bolt hole 17, it is necessary to insure some amount of thickness for a boss portion of a head bolt hole 17 in the block outer wall portions 13, in order to suppress deformation of the cylinder bore 11*a* when attaching a component while insuring fastening force of the head bolt. As a result, it is difficult to provide a portion such as a coolant water path or a hollow portion in a portion that is comparatively close to a head bolt hole 17. Therefore, cooling of the lower portion of the cylinders 11 is impaired by adopting a shallowed structure in the water jacket in this portion as well. Accordingly, in a portion that is comparatively close to a head bolt hole 17, a shallowed structure is not adopted, and cooling of the lower portion of the cylinders 11 is insured by the deep portions 22 of the water jacket 20'.

Also, by providing an inclined portion 23 between a shallow portion 21 and a deep portion 22, the coolant water flows more smoothly than in a case where such an inclined portion 23 is not provided, so cooling of the cylinders 11 can be further improved. Also, by providing an inclined portion 23, processing of the coolant water paths 24 in the bottom wall portions 13*a*' is more easily performed. For example, when the coolant water paths 24 are formed by a drilling process, it is necessary for the holes 24*a* and 24*b* of a coolant water path 24 to be connected to each other below the shallow portion 21, and in this case, the process of drilling the holes 24*a* and 24*b* of a coolant water path 24 can be performed in the bottom face 23*a* of an inclined portion 23 more easily than in a bottom face 21*a* of a shallow portion 21. That is, by using a bottom face 23*a* of an inclined portion 23 as the processing face of the drilling process, a drilling process that connects the holes 24*a* and 24*b* to each other can easily be performed.

Modified Examples

Above, embodiments of the present invention were described, but these embodiments are only examples, and can be modified in various ways. Such modified examples are described below.

(1) The present invention can be applied, for example, to a cylinder block having a siamese structure used in an in-line four-cylinder diesel engine for use in an automobile, but this is not a limitation; the present invention is also applicable to a cylinder block of a gasoline engine. The invention is also applicable to a cylinder block that does not have a siamese structure. Furthermore, the invention is not limited to application to a cylinder block of an engine for use in an automobile; the invention is also applicable to a cylinder block of an engine used in applications other than an automobile. Also, the number of cylinders, the engine format (engine type such as in-line engine, V-type engine, or horizontally oriented engine) and so forth are not particularly limited.

(2) For a die cast cylinder block, a configuration may be adopted in which the cylinder block is structured by integrally casting a cast iron liner. By using a cast iron liner in this way, it becomes easy to insure the mechanical strength, wear resistance, heat resistance, and so forth of the cylinder bore inner face where the piston slides.

(3) In the above first and second embodiments, a configuration is adopted in which an inclined portion is provided between a shallow portion and a deep portion, but a configuration may also be adopted in which such an inclined portion is not provided. Also, the inclination angle of the bottom face of an inclined portion may be other than 45 degrees. Furthermore, the shape of the bottom face of an inclined portion may be other than a flat face. However, as described above, in order to allow the coolant water to flow smoothly, it is preferable to provide an inclined portion between a shallow portion and a deep portion, and in order to facilitate a process of drilling a coolant water path, it is preferable to use a flat face for the bottom face of an inclined portion.

Figure 6:
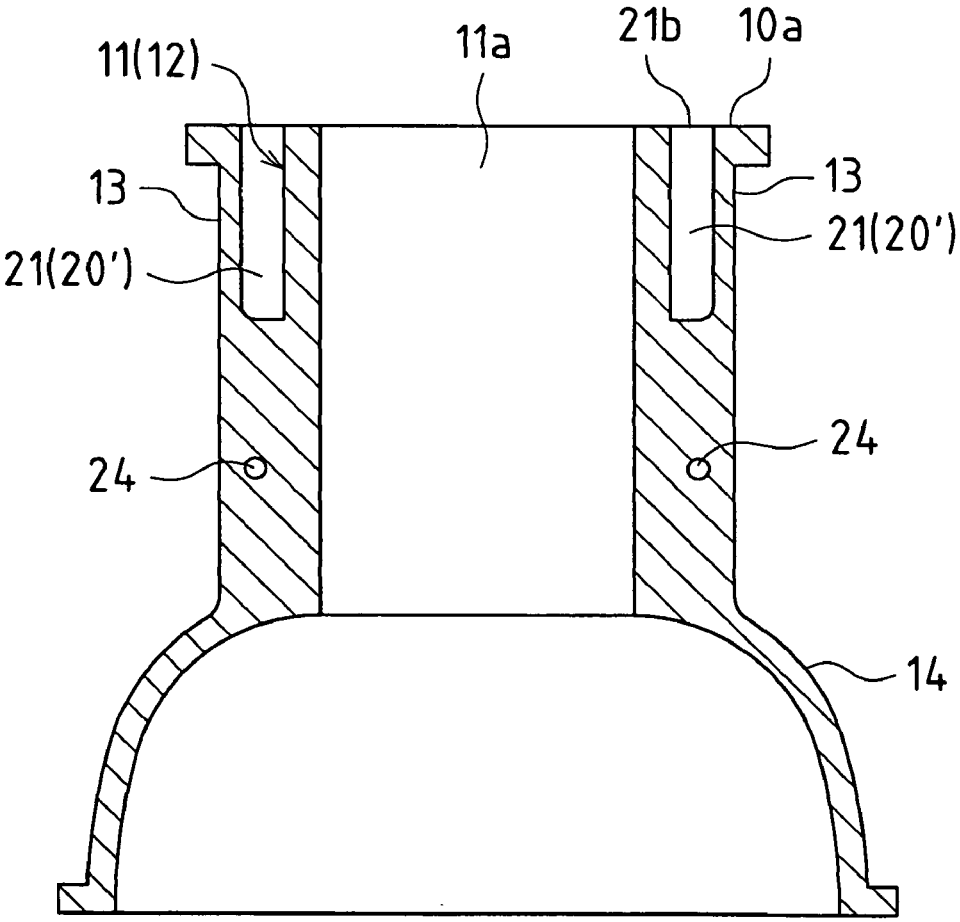
FIG. 6 shows a cylinder block according to a modified example of the second embodiment of the present invention, and corresponds to FIG. 2.

(4) In the above second embodiment, a configuration is adopted in which coolant water paths and hollow portions are provided, but as long as it is possible to insure cooling of the lower portion of the cylinders with only the coolant water paths, a configuration may also be adopted in which hollow portions are not provided, as shown in FIG. 6. Also, the shape of the coolant water paths, the cross-sectional shape and size (hole diameter) of holes in the coolant water paths, the inclination angle of the holes in the coolant water paths relative to the deck face, the angle at which the holes in the coolant water paths are connected to each other, and so forth are not limited to those described above.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

INDUSTRIAL APPLICABILITY

The cylinder block of the present invention is useful as a cylinder block used in an internal combustion engine such as an automobile engine, and other than the cylinder block having a siamese structure used in an in-line four-cylinder diesel engine for use in an automobile that was given as an example application of the present invention, is also applicable to a cylinder block in a gasoline engine. The cylinder block of the present invention is also applicable to a cylinder block that does not have a siamese structure. Furthermore, the present invention is not limited to use in an automobile, and is also applicable to a cylinder block of an engine used in another application.

The invention claimed is:

1. An open deck type cylinder block in which a water jacket that extends in the direction of a line of cylinders is formed on both sides around the cylinders, and this water jacket is open at a deck face:

a shallow portion and a deep portion respectively being provided in portions of the water jacket on both sides that extend in the direction of the line of cylinders;

a bottommost portion of the shallow portion being provided in a portion that is comparatively far from a head bolt hole where a head bolt for attaching a cylinder head is fastened, while on the other hand a bottommost portion of the deep portion is provided in a portion that is comparatively close to the head bolt hole; and a hollow portion in which a block outer wall is hollowed toward a cylinder center side being provided between a bottom wall portion of the shallow portion and a crank case.

2. An open deck type cylinder block in which a water jacket that extends in the direction of a line of cylinders is formed on both sides around the cylinders, and this water jacket is open at a deck face:

a shallow portion and a deep portion respectively being provided in portions of the water jacket on both sides that extend in the direction of the line of cylinders;

a bottommost portion of the shallow portion being provided in a portion that is comparatively far from a head bolt hole where a head bolt for attaching a cylinder head is fastened, while on the other hand a bottommost portion of the deep portion is provided in a portion that is comparatively close to the head bolt hole; and a coolant water path being provided in a portion on a crank case side in a cylinder axis direction of the shallow portion.

3. An open deck type cylinder block in which a water jacket that extends in the direction of a line of cylinders is formed on both sides around the cylinders, and this water jacket is open at a deck face:

a shallow portion and a deep portion respectively being provided in portions of the water jacket on both sides that extend in the direction of the line of cylinders;

a bottommost portion of the shallow portion being provided in a portion that is comparatively far from a head bolt hole where a head bolt for attaching a cylinder head is fastened, while on the other hand a bottommost portion of the deep portion is provided in a portion that is comparatively close to the head bolt hole; and a coolant water path being provided in a portion on a crank case side in a cylinder axis direction of the shallow portion, and a hollow portion in which a block outer wall is hollowed toward a cylinder center side being provided between a bottom wall portion of the shallow portion and the crank case.

4. The cylinder block according to claim 2, wherein the coolant water path is formed by a drilling process.

5. The cylinder block according to claim 1, wherein an inclined portion having an inclined bottom face is provided between the shallow portion and the deep portion.

6. The cylinder block according to claim 3, wherein the coolant water path is formed by a drilling process.

7. The cylinder block according to claim 2, wherein an inclined portion having an inclined bottom face is provided between the shallow portion and the deep portion.

8. The cylinder block according to claim 3, wherein an inclined portion having an inclined bottom face is provided between the shallow portion and the deep portion.

9. The cylinder block according to claim 4, wherein an inclined portion having an inclined bottom face is provided between the shallow portion and the deep portion.

10. The cylinder block according to claim 6, wherein an inclined portion having an inclined bottom face is provided between the shallow portion and the deep portion.

* * * * *